United States Patent [19]

McDermott et al.

[11] Patent Number: 5,055,766

[45] Date of Patent: Oct. 8, 1991

[54] VOLTAGE REGULATOR COMPENSATION IN POWER DISTRIBUTION CIRCUITS

[75] Inventors: Brian McDermott, Mt Holly; Robert L. Morgan, Huntersville, both of N.C.

[73] Assignee: Duke Power Company, Charlotte, N.C.

[21] Appl. No.: 532,599

[22] Filed: Jun. 4, 1990

[51] Int. Cl.[5] ..... G05F 1/14

[52] U.S. Cl. ..... 323/255; 323/257; 323/340; 323/341

[58] Field of Search ..... 323/255, 256, 257, 258, 323/340, 341, 343

[56] References Cited

U.S. PATENT DOCUMENTS

| | | | |
|---|---|---|---|
| 3,619,765 | 6/1970 | Wood | 323/258 |
| 4,336,490 | 6/1982 | Lewis | 323/256 |
| 4,413,189 | 11/1983 | Bottom | 323/256 |
| 4,419,619 | 12/1983 | Jindrick et al. | 323/257 |
| 4,591,831 | 5/1986 | D'Anci | 323/341 |
| 4,695,737 | 9/1987 | Rabon et al. | 323/257 |
| 4,896,092 | 1/1990 | Flynn | 323/340 |

OTHER PUBLICATIONS

General Electric Company, *Instructions—Type ML*32 *Single-Phase Step Voltage Regulators* (GEK-16999A).

*Primary Examiner*—Steven L. Stephan
*Assistant Examiner*—Jeffrey Sterrett
*Attorney, Agent, or Firm*—Shefte, Pinckney & Sawyer

[57] ABSTRACT

An electronic device for compensating voltage fluctuations in an electrical power distribution circuit controls operation of a transformer of the type having a TCUL voltage regulator by automatically calculating the voltage bandwidth of the transformer based upon a stored value for peak current in the distribution circuit. The peak current value is automatically updated when the actual current in the circuit exceeds the stored peak current value for a predetermined sustained period of time indicating a change in overall loading patterns in the circuit but, regardless of increases in actual current in the distribution circuit, the apparatus prevents the output voltage from exceeding a preset absolute maximum.

12 Claims, 6 Drawing Sheets

PEAK LOAD VALUE = 100%
BASE VOLTAGE = 119 TO 121
BOOST VOLTAGE = 7
NO PEAK LOAD UPDATE YET

PEAK LOAD VALUE = 220%
BASE VOLTAGE = 119 TO 121
BOOST VOLTAGE = 7
PEAK LOAD UPDATE HAS OCCURED

BASE VOLTAGE = 119 TO 121
R VALUE = 7

VOLTAGE REGULATOR COMPENSATION IN POWER DISTRIBUTION CIRCUITS

BACKGROUND OF THE INVENTION

The present invention relates generally to electrical power distribution and, more particularly, to the regulation of voltage in a distribution circuit to compensate for fluctuation in the load placed on the circuit.

It is widely recognized within the electrical utility industry that, under ideal conditions, electrical power should be delivered from distribution substations to distribution circuits at maximum voltage levels when current levels are highest during periods of peak load and, conversely, at minimum voltage levels when current levels are lowest during periods of relatively light load. As is well known, the amount of voltage originating in a distribution circuit from its distribution substation determines the current or load capacity of the circuit and the distance along the circuit to which customers can be supplied with adequate voltage. As will be apparent, if the level of voltage delivered to a customer is too low, the voltage will be insufficient to properly operate the customer's electrical devices and appliances and, further, can potentially damage the devices and appliances. On the other hand, excessive voltage for the prevailing current in the distribution circuit poses a danger of damaging transformers in the circuit as well as potential damage to customers' electrical devices and appliances, while also representing a substantial waste of electrical energy.

Conventional approaches to the ongoing problem of load variations in electrical distribution circuits are largely inadequate. Under one approach, when the sustained current levels under peak load conditions have increased over time in a distribution circuit to the point that the circuit cannot adequately service customers, the electrical transmission lines in the circuit may be replaced with transmission lines offering lesser electrical resistance so that voltage is maintained at an adequate level at a greater distance along the distribution circuit from the substation. However, this technique, commonly referred to as reconductoring, is very expensive, costing as much as $20,000 to $30,000 per mile of power distribution line. Further, reconductoring does not provide the distribution circuit with any ability to adjust or compensate for voltage fluctuations in the distribution circuit resulting from changing loads placed on the circuit.

To address this latter problem, a distribution circuit transformer may be equipped with a so-called tap change under load (TCUL) voltage regulator which is operative to maintain the voltage output from the transformer within a maximum-minimum band width or range, typically three volts. Thus, if the prevailing voltage leaving the transformer exceeds the predetermined maximum voltage, the TCUL regulator lowers the voltage output to the upper limit of the acceptable range. Conversely, if the voltage output from the transformer falls below the predetermined minimum voltage, the regulator increases the voltage output of the transformer to the lower limit of the range. As will thus be understood, when the load on the distribution circuit is sufficiently high to reduce the voltage output from the transformer below the lower limit of the established band width, the regulator will merely insure a minimum voltage output from the transformer whereas optimally the voltage output should be maximized under such conditions. Conversely, under conditions of sufficiently light loading on the distribution circuit to cause the voltage output from the transformer to exceed the predetermined maximum limit of the band width, the regulator will merely insure that the voltage output of the regulator is limited to a maximum voltage level, whereas a minimum voltage would be optimal under such conditions.

Voltage regulators of the TCUL type may also be provided with a voltage compensation arrangement by which the maximum-minimum voltage band width is automatically adjusted upwardly and downwardly in relation to fluctuations in the current in the distribution circuit over the course of time. Such compensation arrangements suffer several disadvantages, however, which have prevented the widespread acceptance and practical implementation thereof. In order to program a compensation arrangement to properly control adjustment of the voltage band width of the associated voltage regulator, various control settings must be made both on the basis of predictions of future expected fluctuations in the loading of the distribution circuit and on the basis of regular monitoring of the voltage regulator. Quite obviously, the prediction of future current fluctuations in a distribution circuit, particularly the timing and current levels under peak loading conditions, is virtually impossible beyond very general predictions and estimates which are of insufficient accuracy to provide a basis for establishing reliable settings. On the other hand, the ongoing monitoring, calculations and periodic re-setting of a compensation arrangement is so highly labor intensive as to largely offset the purported benefits of voltage compensation. Importantly, conventional voltage compensation arrangements have no means of limiting the upward adjustment of the voltage band width of the voltage regulator. Accordingly, without frequent monitoring and re-setting of conventional compensation arrangements, the voltage band width will gradually be adjusted upwardly as the peak current levels experienced in the distribution circuit naturally increase over time, to the point that the output voltage from the associated transformer will be undesirably high.

SUMMARY OF THE INVENTION

It is accordingly an object of the present invention to provide a method and apparatus for automatically controlling operation of a TCUL voltage regulator of a transformer in an electrical power distribution circuit to compensate for increases in the electrical current in the circuit, which optimally achieves high voltage output levels under peak loading conditions and low voltage output levels under light loading conditions while avoiding the necessity of periodic monitoring and resetting and preventing excessive upward shifting of the voltage band width of the regulator.

Briefly summarized, the compensation method and apparatus of the present invention achieves this objective by pre-establishing a peak value for the current in the distribution circuit and determining changeable maximum and minimum values for the voltage output of the transformer, i.e. its band width, in relation to the established peak current value. During operation, the actual voltage output of the transformer is monitored and adjusting operation of the voltage regulator is actuated as necessary to maintain the actual voltage output of the transformer within the band width. At the same time, the compensation method and apparatus monitors the actual current prevailing in the distribution circuit and compares the actual current with the established peak current value. When the actual current has exceeded the peak current value for a predetermined period of time, the peak current value is re-established at the higher value of the actual current.

In the preferred embodiment of the present compensation method and apparatus, the voltage output band width for the transformer is determined by initially calculating a compensation ratio of the established peak current value to the actual prevailing current and then calculating the changeable maximum and minimum voltage output values based on the compensation ratio. Specifically, the changeable maximum and minimum voltage output values are calculated according to the equations:

$$A=[BV+(R\times BS)]-(\tfrac{1}{2}\,BW)$$

$$B=[BV+(R\times BS)]+(\tfrac{1}{2}\,BW)$$

wherein A is the changeable minimum voltage output value of the transformer band width, B is the changeable maximum voltage output of the transformer band width, BV is a base voltage value, R is the compensation ratio, BS is a predetermined factor of addition to the base voltage value, and BW is the voltage band width.

In accordance with one important aspect of the present compensation method and apparatus, the calculated compensation ratio is assigned a value of one (1) when the actual prevailing current in the distribution circuit exceeds the established peak current value, which insures that the calculated changeable maximum voltage output value cannot exceed an absolute maximum voltage output value under the above-described calculation. Thus, regardless of the actual current prevailing in the distribution circuit, the actual voltage output of the transformer cannot exceed such absolute maximum voltage output value.

Preferably, the predetermined time period over which the actual current must be sustained in excess of the established peak current value before the peak current value is re-established is selected to be of a sufficient duration such that the sustained elevated actual prevailing current is indicative of a change in overall current patterns in the distribution circuit warranting a change in the established peak current value which, as described, forms the basis for the calculation of the changeable maximum and minimum voltage output values for the transformer. Depending upon the particular distribution circuit, the time period may be set as a matter of minutes or hours. For many distribution circuits in urban environments, a time period of approximately fifteen minutes is considered suitable.

In the preferred embodiment, the adjustment of the voltage regulator to maintain the actual voltage output of the transformer within the calculated voltage output values is accomplished by comparing the actual voltage output of the transformer with the calculated changeable maximum and minimum voltage values which define the band width limits and delaying the actuation of the voltage regulator until the actual voltage output of the transformer has remained outside the band width for another predetermined period of time. This time period is selected to be relatively short but of sufficient duration to avoid repetitive actuations of the voltage regulator in response to momentary voltage surges and drops.

FIGS. *3a*, *3b* and *3c*, collectively, are a block diagram of the program logic carried out by a central microcontroller of the present voltage compensation apparatus;

FIG. *4a* is a graph plotting voltage output by the transformer against load placed on the distribution circuit, illustrating performance of the present voltage compensation apparatus prior to re-establishment of the established peak current value;

FIG. *4b* is another graph similar to FIG. *4a*, illustrating the performance of the present voltage compensation apparatus after the peak current value has been re-established after a sustained period of actual current in the distribution circuit in excess of the initial established peak current value; and FIG. *4c* is another graph similar to FIGS. *4a* and *4b*, illustrating, by comparison, the performance of a conventional compensation arrangement.

DESCRIPTION OF THE PREFERRED EMBODIMENT

Figure 1:
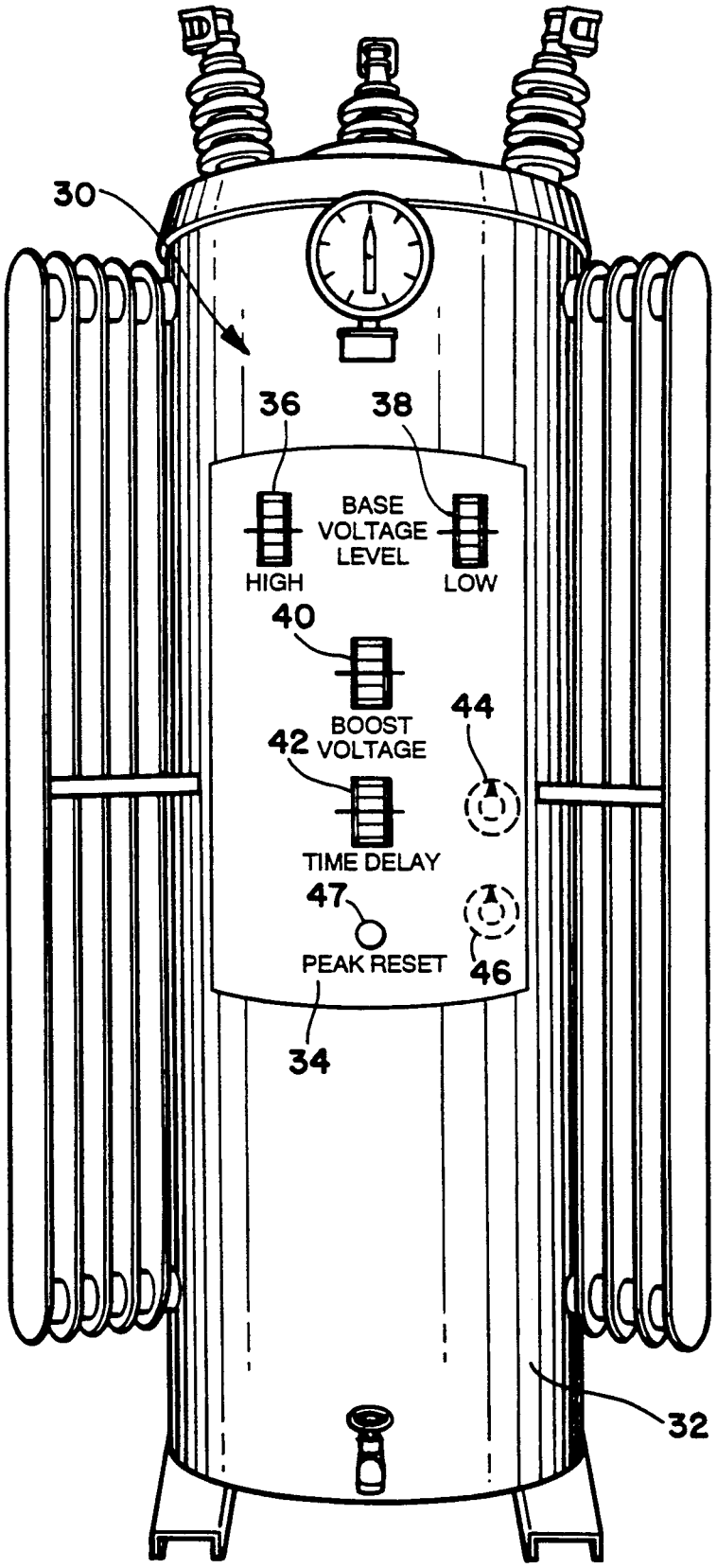
FIG. 1 is a front elevational view of the control panel of a voltage compensation apparatus according to the preferred embodiment of the present invention, as installed on a conventional transformer of the type equipped with a TCUL voltage regulator.

Referring now to the accompanying drawings and initially to FIG. 1, an electronic voltage compensation apparatus according to the present invention is generally indicated at 30 as preferably installed on an electrical power transformer, indicated generally at 32, of the type equipped with a tap change under load (TCUL) voltage regulator. Such transformers and their voltage regulators are of well-known conventional construction and operation, which therefore need not be described in detail herein. As more fully described hereinafter, the present compensation apparatus 30 is adapted to operate based on predetermined input values for high and low so-called base voltage levels, a so-called boost voltage value, a so-called peak current value, one time delay value for controlling actuation of the TCUL voltage regulator of the transformer 32, and another time delay value for controlling updating of the peak current value. The compensation apparatus 30 is provided with a control panel 34 whereat thumb-wheel type switches 36, 38, 40, 42 are exposed for operator setting of the high and low base voltage levels, the boost voltage level, and the TCUL regulator time delay, respectively. Internally, the compensation apparatus 30 is additionally provided with an adjustable switch 44 for initially inputting the peak current value and another switch 46 for setting the peak current updating time delay. The thumb-wheel switches 36–42 are accessible at the face of the control panel 34 to enable these values to be selectively reset by unskilled or untrained personnel, while the switches 44, 46 are concealed within the interior of the compensation apparatus 30 for security purposes to avoid resetting of or tampering with these switches except by supervisory or other authorized personnel. The control panel 34 is also provided with a reset switch button 47, described more fully hereinafter.

Under the present invention as more fully described hereinafter, the base and boost voltage values together with the peak current value determine absolute maximum and minimum voltage values between which the output voltage of the transformer 32 must always be maintained regardless of the actual current load placed on the distribution circuit serviced by the transformer 32, while at the same time these values enable the TCUL regulator of the transformer 32 to adjust its voltage output within the full range of such absolute values in direct relation to the actual current load in the circuit. Specifically, the average of the high and low base voltage values provides a single median base voltage value and the difference between the high and low base voltage values provides a band width value. The peak current value enables a compensation ratio to be calculated by dividing the peak current value into the actual prevailing current in the distribution circuit which is continuously monitored by the compensation apparatus 30. The boost voltage value provides a predetermined factor for addition to the base voltage value, which is adjusted by multiplication with the compensation ratio.

According to an important aspect of the present invention, the compensation ratio is never assigned a value in excess of one (1). When the actual current in the distribution circuit exceeds the established peak current value, the compensation ratio is assigned the value of one (1) in each case. Thus, while the boost voltage value is modified according to the compensation ratio determined from the actual prevailing current in the distribution circuit, the absolute maximum voltage that the compensation apparatus 30 will permit the transformer 32 to output is the sum of the median base voltage, the full value of the boost voltage, and one-half of the band width value, regardless of the actual prevailing current and, in particular, regardless of how much the actual current exceeds the established peak current. On the other hand, the absolute minimum voltage the compensation apparatus 30 will permit the transformer 32 to output, assuming a zero prevailing current in the distribution circuit and, in turn, a zero compensation ratio and therefore an adjusted boost voltage value of zero, is the median base voltage less one-half of the band width value, which in all cases will be equivalent to the low base voltage input value.

During ongoing operation of the compensation apparatus 30 as hereinafter described, the upper and lower limits of the voltage band width are continuously adjusted upwardly and downwardly within the overall range between the absolute maximum and minimum voltage output values according to the level of actual current prevailing in the distribution circuit and, in turn, the voltage regulator of the transformer 32 is actuated as necessary to maintain the actual voltage output from the transformer 32 within the then-effective band width. Specifically, at any point in the operation of the compensation apparatus 30, the upper and lower voltage limits of the voltage band width are calculated according to the following formulas:

$$A=[BV+(R\times BS)]-(\tfrac{1}{2}\,BW)$$

$$B=[BV+(R\times BS)]+(\tfrac{1}{2}\,BW)$$

In such formulas, A represents the lower voltage limit of the presently effective voltage band width and B represents the upper voltage limit of the band width. BV represents the base voltage value, i.e., the average of the upper and lower base voltage values. R represents the compensation ratio, i.e., the product of dividing the actual prevailing current by the established peak current, but not greater than one (1). BS represents the boost voltage addition factor. BW represents the band width value, i.e., the difference between the upper and lower base voltage values.

As will be understood, very brief momentary surges and drops may be experienced in the voltage output of the transformer 32 as a result of momentary increases and decreases in the load on the distribution circuit, which voltage changes do not warrant a shift in the voltage band width. Accordingly, to avoid unnecessary repetitive shifting of the voltage band width in response to such momentary voltage fluctuations, the time delay switch 42 is operatively connected to a timer which delays actuation of the voltage regulator for a predetermined time period, typically a matter of a predetermined number of seconds, of sufficient duration to indicate a sustained change in the voltage output of the transformer 32.

According to another feature of the present invention, the peak current value is periodically updated, i.e. re-established, whenever the prevailing current in the distribution circuit has exceeded the then-effective established peak current value for a sufficiently sustained period of time to indicate a change in the loading patterns in the distribution circuit, which as will be understood can be expected to occur periodically over time. For this purpose, the aforementioned time delay switch 46 is operatively connected to a timer in the circuitry of the compensation apparatus 30 to select the applicable time period. As will be understood, the optimal time period to be selected will depend upon and vary in relation to the particular distribution circuit, the type and number of electrical power customers it services, etc. To provide significant flexibility in the application and use of the compensation apparatus 30, it is preferred that the timer be capable of a wide range of settings from relatively short time periods on the order of several minutes to considerably longer time periods on the order of a number of hours. Presently, it is believed that a time period of approximately fifteen minutes is appropriate for distribution circuits in a majority of urban environments.

It will be recognized that periodic re-establishment or updating of the peak current value in this manner automatically affects the calculation of the upper and lower voltage limits of the voltage band width under the above-discussed equations and, in turn, serves to adjust the shifting of the voltage band width of the transformer between the established absolute maximum and minimum voltages in relation to the increasing range of current levels experienced in the distribution circuit. Thus, the possible voltage band width increments within the overall possible voltage output range are better matched to the full range of possible current levels which may occur in the distribution circuit.

Figure 2:
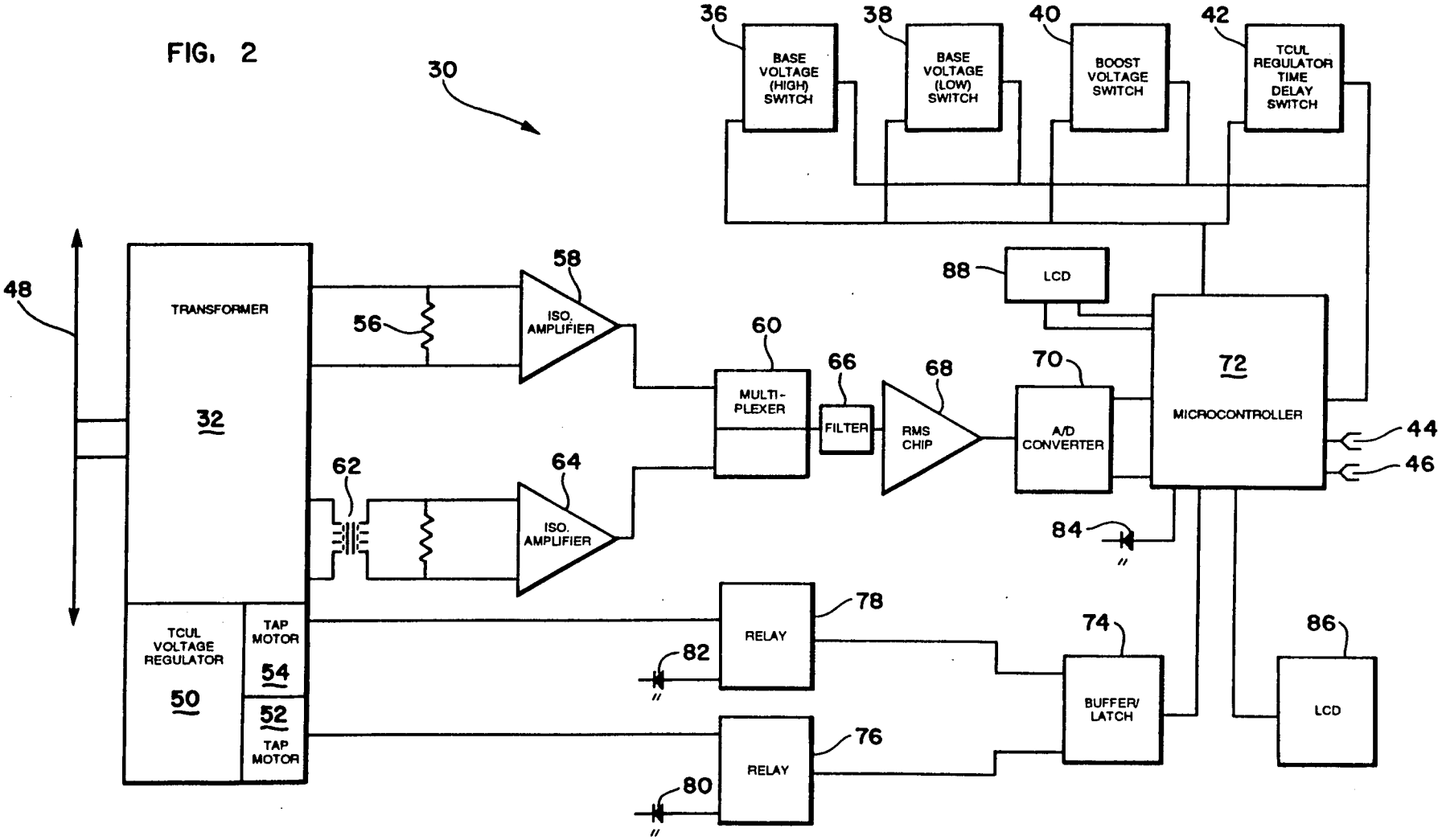
FIG. 2 is a schematic diagram of the electrical operating components of the present voltage compensation apparatus.

With reference now to FIG. 2 of the accompanying drawings, the electronic components and circuitry of the present compensation apparatus 30 are diagrammatically illustrated. The electrical power distribution circuit serviced by the transformer 32 is schematically indicated at 48 and the TCUL voltage regulator of the transformer is schematically indicated at 50. As is well known, such regulators are basically equipped with a pair of so-called tap motors, indicated at 52 and 54, which, when actuated, respectively raise and lower the voltage band width which the transformer 32 is capable of outputting. The compensation apparatus 30 is electrically connected across a suitable resistor 56 to an internal potential transformer (not shown) within the transformer 32 to step down the output voltage from the transformer to 120 VAC to supply operating electrical power to the compensation apparatus 30 while simultaneously enabling it to monitor the output voltage of the transformer 32. The stepped-down voltage from the internal potential transformer is sensed by an isolation amplifier 58 and applied to one channel of a two-channel multiplexer 60. Similarly, the compensation apparatus 30 is electrically connected across a shunt 62 to an internal current transformer (also not shown) within the transformer 32 to convert the actual prevailing current in the distribution circuit to a proportional voltage which, in turn, is sensed by another isolation amplifier 64 and applied to the other channel of the multiplexer 60.

The output of the multiplexer 60 is operatively connected through a low pass filter 66, which eliminates high frequency noise and provides low impedance matching, to a true RMS converter chip 68 which is operative to convert alternating current voltage to equivalent direct current voltage. The direct current output of the converter chip 68 is applied to an analog-to-digital converter 70 which quantifies the analog direct current input into an equivalent digital code. The digitized code produced by the A-D converter 70 is supplied to a central microcontroller or other suitable microprocessor 72 which stores the operating program for the compensation apparatus 30.

The microcontroller 72 is programmed to address the A-D converter 70 by sequential calls to obtain digitized voltage data from the two channels of the multiplexer 60 representing the actual voltage and current values prevailing in the distribution circuit 48. Likewise, the microcontroller 72 addresses the thumb-wheel switches 36, 38, 40, 42 and the internal switches 44, 46 to determine their respective input settings, which are converted according to the stored control program to binary form and stored in the memory of the microcontroller. Based on the inputs from the switches 36–44 and the digitized voltage and current data obtained from the transformer 32, the microcontroller 72 calculates the upper and lower voltage band width limits for the prevailing actual current in the distribution circuit and, as necessary, actuates one of the tap motors 52, 54 of the TCUL regulator 50 to adjust the output voltage of the transformer 32 to bring it within the calculated band width. For this purpose, the microcontroller 72 is operatively connected to a buffer and latch 74 which controls a pair of relays 76, 78 respectively connected to the tap motors 52, 54 for actuation thereof. A light emitting diode 80, 82 may be connected to each relay 76, 78 to be illuminated when the respective relay is operating to actuate its associated tap motor.

The microcontroller 72 is also programmed to actuate the timer associated with the time delay switch 46 upon each occurrence of a current level in the distribution circuit 48 in excess of the peak current value established by the switch 44. When such an elevated current level is not maintained for the preset time period, the timer is cleared and reset, and the established peak current value remains unchanged. However, when an elevated current level is sustained in the distribution circuit 48 in excess of the established peak current value for the predetermined time period, the microcontroller 72 replaces the established peak current value in its non-volatile memory with the more elevated actual current value. Thereafter, the microcontroller 72 bases its calculations of the compensation ratio and, in turn, the upper and lower voltage limits of the voltage band width on the updated peak current value.

Similarly, the microcontroller 72 is connected to another light emitting diode 84 for indicating the operating condition of the compensation apparatus 30. For example, according to the preferred program, the diode 84 is continuously illuminated when the compensation apparatus 30 is idle, e.g., when the actual voltage in the distribution circuit 48 drops below a predetermined level. The program is further operative to cause the diode 84 to blink repetitively when the peak current value is updated. The compensation apparatus 30 may optionally be further provided with one or more digital liquid crystal displays, indicated only generally at 86, to display data such as the prevailing voltage and current in the distribution circuit, the peak current experienced to date, the peak current update time delay, etc. Another input to the microcontroller 72 is also operatively connected to a set of SCADA ("System Control and Data Acquisition") relays 88 of conventional type by which communication with the compensation apparatus 30 may be obtained from a remote location.

The logic routines carried out by the control programs stored in the microcontroller 72 are illustrated diagrammatically in FIGS. *3a, 3b* and *3c*. When the compensation apparatus 30 is first placed into service, the microcontroller 72 initially clears each of the timers associated with the switches 42, 46, clears all input variables from its volatile memory, and then reads the initially established peak current (load) value, designated PLV, from its non-volatile memory. At the same time, the peak load value PLV is also stored as a temporary load value, designated TLV, which is utilized as hereinafter described for purposes of tracking the duration of elevated current levels in the distribution circuit against the peak load timing period determined by the switch 46.

To being its normal operating routine (FIG. *3a*), the microcontroller 72 initially determines whether the peak value reset switch 47 has been depressed and, if so, after a brief time period, e.g., one minute, to permit an operator to input a new peak current value, the microcontroller 72 reads and stores the peak current value PLV from the peak value switch 44 and assigns such value as the temporary load value TLV. The base and boost voltage switches 36, 38, 40 and the time delay switches 42, 46, along with any SCADA input if applicable, are then read and the median base voltage BV and one-half of the voltage band width BW are calculated from such readings. Likewise, the microcontroller 72 addresses the analog-to-digital converter 70 to determine the actual voltage PT and the actual current CT prevailing in the distribution circuit 48 from the potential and current transformers within the transformer 32.

Under the program, the microcontroller 72 next determines whether the prevailing current CT in the distribution circuit 48 exceeds the temporary load value TLV stored in memory. If so, the microcontroller 72 actuates the timer associated with the timer switch 46, unless the timer has already been previously actuated during an earlier performance of the same sub-routine. At this point, the microcontroller 72 stores the prevailing current CT in memory as a new temporary load value TLV.

Having determined the prevailing circuit current CT, the microcontroller 72 next calculates the compensation ratio, as aforementioned, by dividing the actual prevailing current CT by the stored peak load value PLV. However, as mentioned, if the actual current CT exceeds the stored peak load value PLV, the microcontroller 72 assigns the compensation ratio a value of one (1). Based on the ratio R, the upper and lower voltage band width limits A and B are calculated by the formulas discussed above.

Figure 3A:
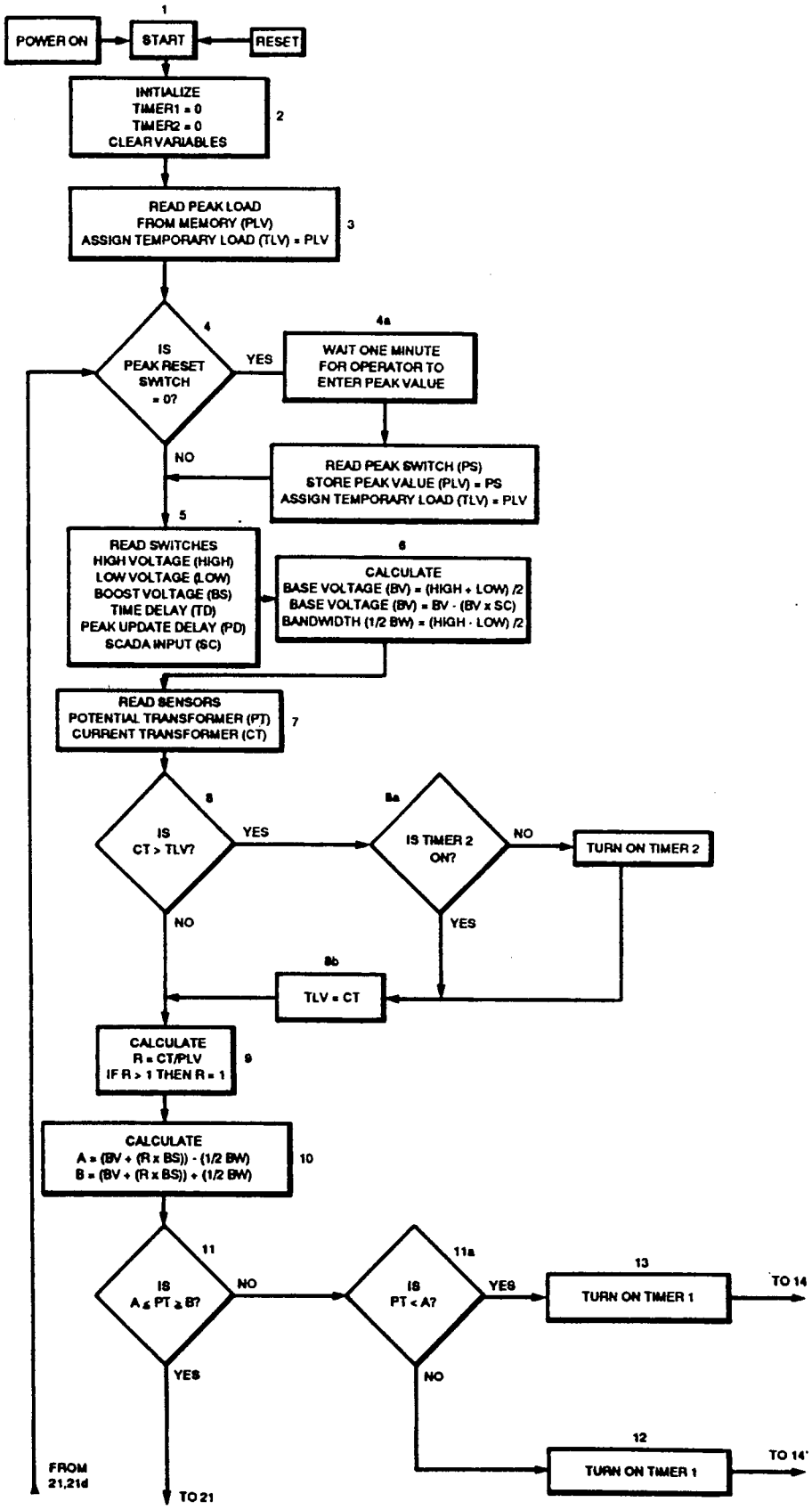
Figure 3B:
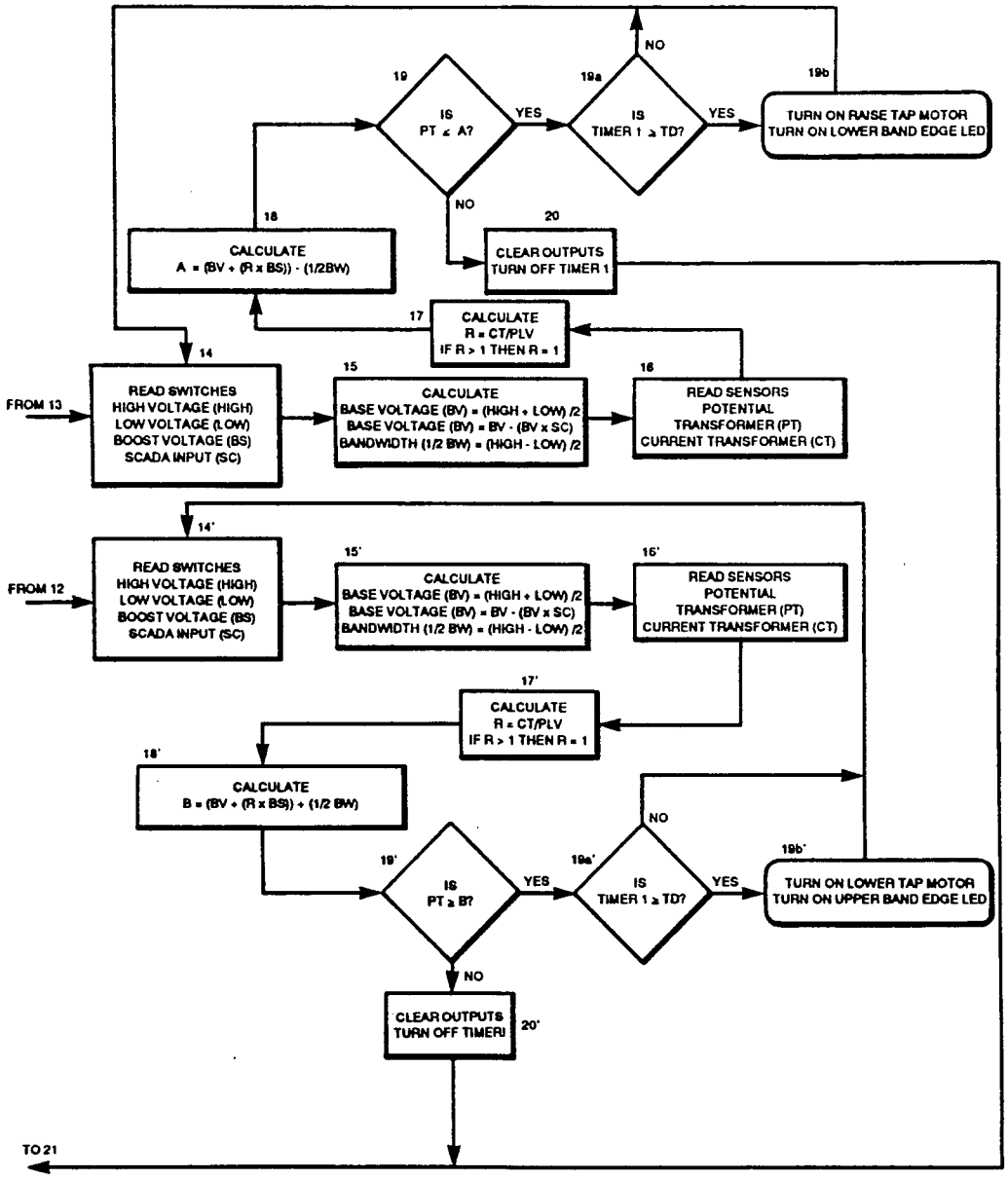
Figure 3C:
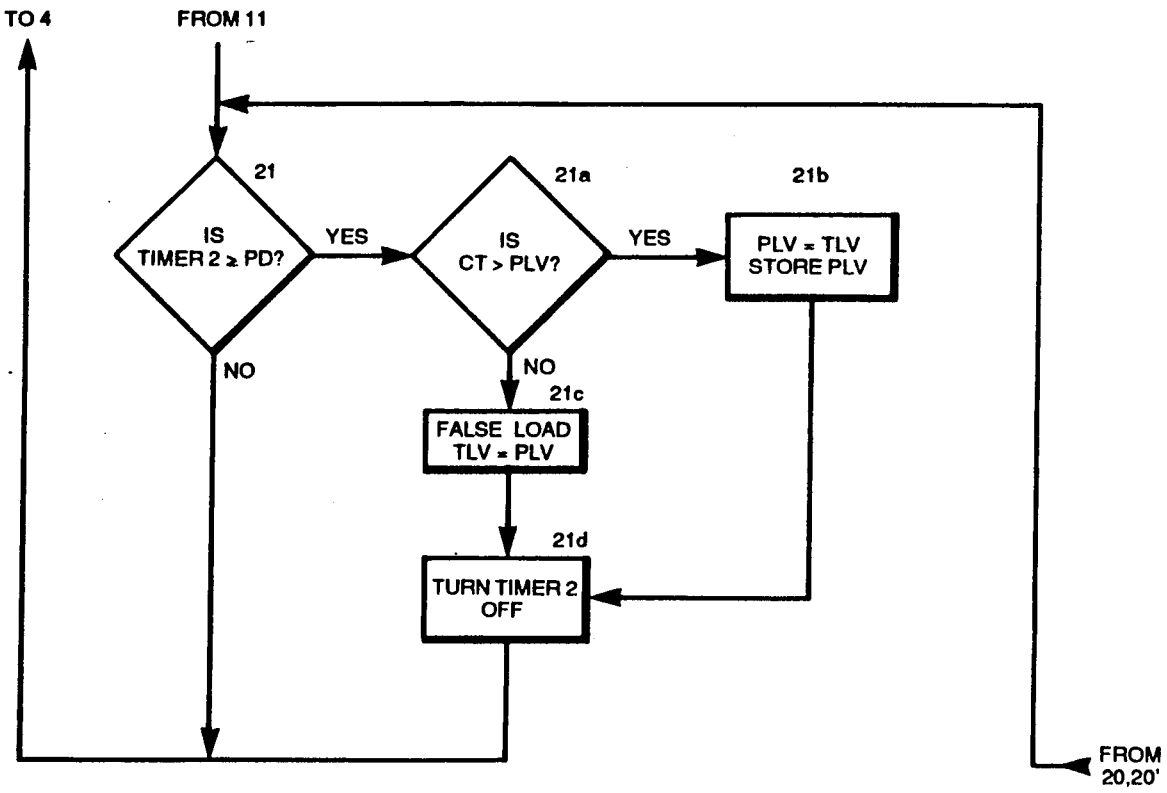

The microcontroller 72 then compares the actual voltage PT prevailing in the transformer 32 as determined from the potential transformer therein, against the upper and lower band width limits A and B to determine whether the actual voltage is within or outside the band width. If the actual voltage PT is within the band width, the microcontroller 72 proceeds to a peak current update routine of the control program described hereinafter (FIG. 3*c*). However, if the actual voltage PT is outside the calculated limits of the voltage band width, the routine next queries whether the actual voltage PT is less than the lower band width limit A. If not, then the voltage must be in excess of the upper band width limit B. In either case, the microcontroller 72 next actuates the timer associated with the time delay switch 42.

As diagrammed in FIG. 3*b*, if the actual voltage PT is below the lower band width limit A, the microcontroller 72 begins a correction sub-routine under which it first re-reads the base and boost voltage switches 36, 38, 40 and, if applicable, the SCADA input SC, recalculates the base voltage and one-half band width values BV and ½ BW, re-reads the actual voltage and current values PT and CT from the potential and current transformers, and recalculates the compensation ratio and the lower band width voltage limit A. The re-performance of these steps is, of course, not necessary but is performed to improve the response time of the program. Next, the microcontroller 72 again determines whether the actual voltage PT remains less than the lower voltage band width limit A. If not, the low voltage reading previously obtained from the potential transformer was a momentary voltage drop and, accordingly, the microcontroller 72 deactuates the timer associated with the time delay switch 42, clears the applicable controller outputs, and proceeds directly to perform the peak current update routine of FIG. 3*c*. However, if the actual voltage PT remains below the lower band width limit A, the microcontroller determines whether the associated timer has yet exceeded its time delay value set by the associated time delay switch 42. If not, the correction sub-routine is repeated When the actual voltage PT has remained below the lower band width limit A for a time period exceeding that set by the time delay switch 42, the microcontroller 72 actuates the applicable tap motor 52 of the TCUL regulator 50 to increase the voltage output of the transformer 32. While the tap motor 52 operates, the correction sub-routine is repeated successive times until the actual voltage PT obtained from the potential transformer is no longer below the lower band width limit A, whereupon the microcontroller 72 deactuates the associated timer, clears the microcontroller outputs, and proceeds to the peak current update routine of FIG. 3*c*, as aforementioned.

In the opposite situation when the actual voltage PT exceeds the upper band width limit B, the microcontroller 72 performs a separate but substantially identical correction routine, except that, in this correction routine, the upper voltage band width limit B is re-calculated, following which the query is made whether the actual voltage PT exceeds the re-calculated upper band width limit B. Under this correction routine, when the actual voltage PT has exceeded the upper band width limit B for a sustained time period in excess of that set by the time delay switch 42, the microcontroller 72 actuates the other TCUL regulator tap motor 54 to lower the voltage output by the transformer 32 until the actual voltage PT is within the voltage range between the calculated band width limits.

Under the peak current update routine diagrammed in FIG. 3*c*, the query is first made whether the peak current update timer has exceeded the time delay value set by its associated switch 46. As aforementioned, this timer would have been previously actuated following the initial reading of the actual circuit current CT from the current transformer if the prevailing current CT exceeded the stored temporary load value TLV. In the peak current update routine, if the timer is deactuated or has yet to exceed the time delay established by the switch 46, the microcontroller 72 returns to the beginning of the control program.

However, when the peak current update timer has remained actuated for a period in excess of the time delay set by the switch 46, the microcontroller 72 then queries whether the actual prevailing current CT exceeds the peak load value PLV. If not, then the higher actual current reading which previously caused the microcontroller 72 to originally actuate the timer is considered to have been a momentary voltage surge or otherwise of too short a duration to represent an overall change in the pattern of customer loading placed on the distribution circuit. Accordingly, the temporary load value TLV is reset to be equivalent to the peak load value PLV established by the switch 44, the peak current update timer is deactuated, and the microcontroller 72 then proceeds to repeat the overall control program.

On the other hand, if the actual prevailing current CT obtained from the current transformer still exceeds the peak load value PLV after the update timer has exceeded its preset time period, the microcontroller 72 replaces the then-established peak load value PLV in its non-volatile memory with the temporary load value TLV, which as aforementioned was previously set to equal the excessive actual current CT. Thus, the higher actual current CT, having been sustained for a sufficient period of time to indicate a change in the overall loading pattern on the distribution circuit, becomes the new peak load value PLV which the microcontroller 72 thereafter uses for purposes of calculating the compensation ratio R. After storing the new peak load value PLV, the update timer is deactuated and the microcontroller 72 proceeds to repeat the overall control program.

Figure 4A:
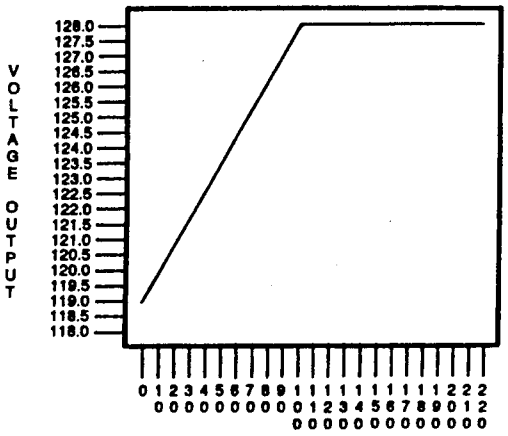
Figure 4B:
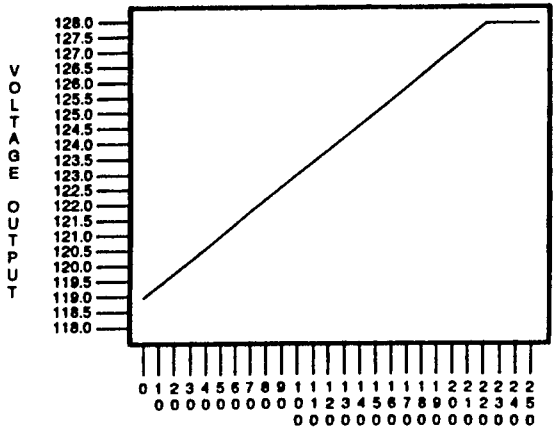
Figure 4C:
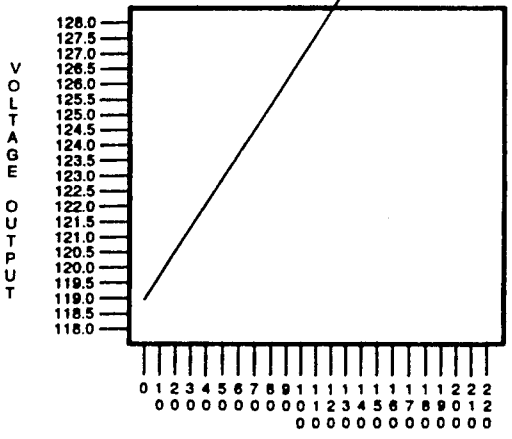

FIGS. 4*a*, 4*b* and 4*c* graphically illustrate the advantageous effect of the method of operation of the present compensation apparatus in comparison to a conventional compensation arrangement. Each of the graphs represents the increase in voltage output from the associated transformer actuated by its TCUL regulator as the current load placed on the distribution circuit increases FIGS. 4*a* and 4*b* represent the operation of the present compensation apparatus when its low and high base voltage values are set at 119 and 121 volts of alternating current and its boost voltage value is set at 7 based upon a predetermined peak value for the current load expected in the distribution circuit, designated in the graphs at the 100% of load mark. FIG. 4*c* represents a conventional compensation arrangement similarly set for a base voltage range between 119 and 121 VAC with a resistance R value of 7, based upon the same projected 100% peak current loading. Thus, in each case, the voltage output is intended to be maintained within an absolute range between 119 and 128 volts of alternating current assuming the expected peak load.

With a conventional compensation arrangement as illustrated in FIG. 4*c*, the voltage output of the transformer 32 is maintained within the established absolute range only so long as the actual current in the distribution circuit does not exceed the predetermined peak current value. However, as the actual current in the circuit increases beyond the peak current value, the compensation arrangement permits the TCUL regulator to continue to correspondingly increase the voltage output of the transformer 32, producing excessive voltage in the circuit and attendant risk or even likelihood of damage to customer's electrical items being operated from the circuit.

In substantial contrast, the present compensation apparatus 30, while also operating to maintain the transformer voltage output within the absolute established range while the actual current is at or below the predetermined peak load value, additionally prevents the voltage output from exceeding the absolute upper voltage limit of the established range when the actual current exceeds the peak current value, as depicted in FIGS. 4*a* and 4*b*. Specifically, FIG. 4*a* illustrates the performance of the present compensation apparatus when an excessive actual current first occurs and before the excessive current has been sustained for a sufficient period of time to warrant an update of the initially established peak current value. As shown, the compensation apparatus 30 maintains the voltage output of the transformer constant at the maximum absolute voltage level as the actual current increases beyond the established peak current, regardless of the amount of such increase. FIG. 4*b*, on the other hand, illustrates the performance of the present compensation apparatus after the distribution circuit has experienced an actual current level at 220% of the initially established peak current value for a sustained period of time in excess of the set peak current update time delay period, whereupon the 220% current value has become the new peak load value. Accordingly, under such conditions, the compensation apparatus 30 continues to maintain the actual voltage output of the transformer within the established absolute voltage range but adjusts the rate of increase in the voltage output in relation to increasing circuit current in accordance with the new, more elevated peak current value. Thus, the actual voltage output from the transformer 32 is better matched to the overall possible range of current levels which may be experienced in the distribution circuit.

The advantages of the present compensation apparatus will thus be understood. First, in substantial contrast to conventional compensation arrangements, the present compensation apparatus automatically adjusts to increases in the peak current experienced in its associated distribution circuit and further controls the associated TCUL regulator to automatically adjust the voltage output of its transformer to produce maximum voltage output under conditions of peak loading on the circuit and minimum voltage output under conditions of light loading while avoiding altogether the development of over voltage conditions, all without the time consuming, labor intensive, and expensive conventional necessity of attempting to predict future peak current levels in the distribution circuit and ongoing periodic monitoring and resetting of the compensation apparatus as is required with conventional compensation arrangements. In normal operation, the present compensation apparatus 30 will operate effectively in this manner for extended periods of time essentially without any operator intervention. The production of maximum voltage output under peak loading conditions increases the distribution circuit capacity enabling the circuit to service customers with adequate voltage at a greater distance from the distribution substation without any change in existing transmission lines and without necessitating installation of additional or new voltage regulators. The use of a programmable microcontroller or other microprocessor for storing the control program for the compensation apparatus, together with the provision of SCADA input relays, enables diagnostic routines to be performed on the compensation apparatus for purposes of routine monitoring and trouble-shooting when problems occur. Further, the microcontroller enables the control program to be selectively changed to suit differing load conditions and differing distribution circuits, e.g., by simply replacing an integrated circuit EPROM or similar computer chip in the microcontroller. Additionally, the preferred components for the compensation apparatus are solid state electronic devices which provide reliable operation with low maintenance and also enable the compensation apparatus to be manufactured at relatively low cost.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In an electrical power distribution circuit including a transformer having a voltage regulator of the tap change under load type for adjusting the output voltage of the transformer, the improvement comprising a method of automatically controlling operation of the voltage regulator to compensate for increases in the electrical current in the distribution circuit, the method comprising the steps of establishing a peak value for the current in the distribution circuit, determining changeable maximum and minimum values for the voltage output of the transformer in relation to the established peak current value, monitoring the actual voltage output of the transformer, actuating adjusting operation of the voltage regulator to maintain the actual voltage output of the transformer between the changeable maximum and minimum voltage values, monitoring the actual current in the distribution circuit, comparing the actual current with the established peak current value, and re-establishing the peak current value at the actual current when the actual current has exceeded the peak current value for a predetermined period of time.

2. A method of automatically controlling operation of a voltage regulator in an electrical power distribution circuit according to claim I and characterized further in that the step of determining the changeable maximum and minimum voltage output values comprises the steps calculating a compensation ratio of the peak current value to the actual current and calculating the changeable maximum and minimum voltage output values based on the compensation ratio.

3. A method of automatically controlling operation of a voltage regulator in an electrical power distribution circuit according to claim 2 and characterized further in that the step of calculating the compensation ratio comprises assigning the compensation ratio a value of one (1) when the actual current exceeds the established peak current value, whereby the actual voltage output of the transformer does not exceed a predetermined absolute maximum voltage output value regardless of the actual current.

4. A method of automatically controlling operation of a voltage regulator in an electrical power distribution circuit according to claim 3 and characterized further in that the step of determining the changeable maximum and minimum voltage output values comprises the steps of calculating the changeable maximum and minimum voltage output values according to the equations:

$$A=(BV+(R\times BS))-(\tfrac{1}{2}BW)$$

$$B=(BV+(R\times BS))+(\tfrac{1}{2}BW)$$

wherein A is the changeable minimum voltage output value, B is the changeable maximum voltage output value, BV is a base voltage value, R is the compensation ratio, BS is a predetermined factor of addition to the base voltage value, and BW is a band width value.

5. A method of automatically controlling operation of a voltage regulator in an electrical power distribution circuit according to claim 1 and characterized further by selecting the predetermined period of time of a sufficient duration to represent a change in current patterns in the distribution circuit when the actual current is sustained in excess of the established peak current value for the predetermined period of time.

6. A method of automatically controlling operation of a voltage regulator in an electrical power distribution circuit according to claim 1 and characterized further in that the step of actuating adjusting operation of the voltage regulator comprises the steps of comparing the actual voltage output of the transformer with the changeable maximum and minimum voltage values and delaying actuation of the voltage regulator until the actual voltage output of the transformer has remained outside the range between the changeable maximum and minimum voltage values for a second predetermined period of time.

7. In an electrical power distribution circuit including a transformer having a voltage regulator of the tap change under load type for adjusting the output voltage of the transformer, the improvement comprising an apparatus for automatically controlling operation of the voltage regulator to compensate for increases in the electrical current in the distribution circuit, the apparatus comprising means for establishing a peak value for the current in the distribution circuit, means for determining changeable maximum and minimum values for the voltage output of the transformer in relation to the established peak current value, means for monitoring the actual voltage output of the transformer, means for actuating adjusting operation of the voltage regulator to maintain the actual voltage output of the transformer between the changeable maximum and minimum voltage values, means for monitoring the actual current in the distribution circuit, means for comparing the actual current with the established peak current value, and means for re-establishing the peak current value at the actual current when the actual current has exceeded the peak current value for a predetermined period of time.

8. An apparatus for automatically controlling operation of a voltage regulator in an electrical power distribution circuit according to claim 7 and characterized further in that the means for determining the changeable maximum and minimum voltage output values comprises means for calculating a compensation ratio of the peak current value to the actual current and means for calculating the changeable maximum and minimum voltage output values based on the compensation ratio.

9. An apparatus for automatically controlling operation of a voltage regulator in an electrical power distribution circuit according to claim 8 and characterized further in that the means for calculating the compensation ratio comprises means for assigning the compensation ratio a value of one (1) when the actual current exceeds the established peak current value, whereby the actual voltage output of the transformer does not exceed a predetermined absolute maximum voltage output value regardless of the actual current.

10. An apparatus for automatically controlling operation of a voltage regulator in an electrical power distribution circuit according to claim 9 and characterized further in that the means for determining the changeable maximum and minimum voltage output values comprises means for calculating the changeable maximum and minimum voltage output values according to the equations:

$$A=(BV+(R\times BS))-(\tfrac{1}{2}BW)$$

$$B=(BV+(R\times BS))+(\tfrac{1}{2}BW)$$

wherein A is the changeable minimum voltage output value, B is the changeable maximum voltage output value, BV is a base voltage value, R is the compensation ratio, BS is a predetermined factor of addition to the base voltage value, and BW is a bandwidth value.

11. An apparatus for automatically controlling operation of a voltage regulator in an electrical power distribution circuit according to claim 7 and characterized further in that the means for re-establishing the peak current value comprises timer means for setting the predetermined period of time of a sufficient duration to represent a change in current patterns in the distribution circuit when the actual current is sustained in excess of the established peak current value for the predetermined period of time.

12. An apparatus for automatically controlling operation of a voltage regulator in an electrical power distribution circuit according to claim 7 and characterized further in that the means for actuating adjusting operation of the voltage regulator comprises means for comparing the actual voltage output of the transformer with the changeable maximum and minimum voltage values and timer means for delaying actuation of the voltage regulator until the actual voltage output of the transformer has remained outside the range between the changeable maximum and minimum voltage values for a second predetermined period of time.

* * * * *